US009885975B2

(12) United States Patent
Moon et al.

(10) Patent No.: US 9,885,975 B2
(45) **Date of Patent: *Feb. 6, 2018**

(54) ELECTROPHOTOGRAPHIC IMAGE FORMING APPARATUS

(71) Applicant: S-PRINTING SOLUTION CO., LTD., Suwon-si, Gyeonggi-do (KR)

(72) Inventors: Ji-won Moon, Suwon-si (KR); Yong-il Moon, Seoul (KR); Sang-hoon Lee, Suwon-si (KR); Yong-kwan Cho, Suwon-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/472,443

(22) Filed: Mar. 29, 2017

(65) Prior Publication Data

US 2017/0199482 A1 Jul. 13, 2017

Related U.S. Application Data

(63) Continuation of application No. 14/677,308, filed on Apr. 2, 2015, now Pat. No. 9,645,525.

(30) Foreign Application Priority Data

Jun. 3, 2014 (KR) ..... 10-2014-0067794

(51) Int. Cl.
*G03G 15/08* (2006.01)
*G03G 21/18* (2006.01)

(52) U.S. Cl.
CPC ..... *G03G 15/0865* (2013.01); *G03G 15/0808* (2013.01); *G03G 15/0831* (2013.01);
(Continued)

(58) Field of Classification Search
CPC ..... G03G 15/0808; G03G 15/0832; G03G 15/0839; G03G 15/0865; G03G 21/12; G03G 21/18; G03G 21/1821
(Continued)

(56) References Cited

U.S. PATENT DOCUMENTS 5,003,917 A 4/1991 Toyoshi et al.
5,565,973 A 10/1996 Fujishiro et al.
(Continued)

FOREIGN PATENT DOCUMENTS

EP 1462866 1/2008
JP 2013-109073 6/2013
(Continued)

OTHER PUBLICATIONS

Korean Office Action dated Aug. 24, 2015 in Korean Patent Application No. 10-2014-0067794.
(Continued)

*Primary Examiner* — Benjamin Schmitt
(74) *Attorney, Agent, or Firm* — Staas & Halsey LLP

(57) ABSTRACT

An electrophotographic image forming apparatus includes a cartridge for forming a visible toner image. The cartridge includes a development chamber having a toner inlet through which toner is supplied into the development chamber, a development roller provided in the development chamber, and a supply roller provided in the development chamber that supplies toner to the development roller. The cartridge further includes a first toner transporting member that transports toner supplied through the toner inlet in an axial direction of the supply roller, and a toner supply guide that is disposed between the first toner transporting member and the supply roller and includes a slit which has a length in the axial direction and through which toner is dropped
(Continued)

onto the supply roller. The toner supply guide is downwardly inclined in the axial direction.

20 Claims, 9 Drawing Sheets

(52) U.S. Cl.
CPC ..... *G03G 15/0891* (2013.01); *G03G 21/1821* (2013.01); *G03G 2215/0827* (2013.01); *G03G 2215/0891* (2013.01); *G03G 2221/1853* (2013.01)

(58) Field of Classification Search
USPC ..... 399/111, 120, 262, 281
See application file for complete search history.

(56) References Cited

U.S. PATENT DOCUMENTS

| | | | |
|---|---|---|---|
| 6,173,130 | B1 | 1/2001 | Oguma |
| 8,811,862 | B2 | 8/2014 | Nagashima |
| 8,862,029 | B2 | 10/2014 | Shimizu et al. |
| 2005/0002698 | A1 | 1/2005 | Jeon |
| 2007/0077096 | A1 | 4/2007 | Otani |
| 2008/0260430 | A1 | 10/2008 | Sakamoto et al. |
| 2008/0292363 | A1 | 11/2008 | Moon et al. |
| 2011/0280623 | A1 | 11/2011 | Heo et al. |
| 2012/0177399 | A1 | 7/2012 | Kim et al. |

FOREIGN PATENT DOCUMENTS

| | | |
|---|---|---|
| KR | 10-2008-0030300 | 4/2008 |
| KR | 10-2008-0102624 | 11/2008 |
| KR | 2008-268506 | 11/2008 |
| KR | 10-2011-0124603 | 11/2011 |
| KR | 10-2012-0117668 | 10/2012 |
| KR | 10-2013-0058609 | 6/2013 |

OTHER PUBLICATIONS

Extended European Search Report dated Nov. 23, 2015 in European Patent Application No. 15165121.3.

U.S. Office Action dated Aug. 12, 2015 in co-pending U.S. Appl. No. 14/677,308.

U.S. Final Office Action dated Dec. 9, 2015 in co-pending U.S. Appl. No. 14/677,308.

U.S. Advisory Action dated Feb. 9, 2016 in co-pending U.S. Appl. No. 14/677,308.

U.S. Office Action dated Apr. 27, 2016 in co-pending U.S. Appl. No. 14/677,308.

U.S. Final Office Action dated Aug. 19, 2016 in co-pending U.S. Appl. No. 14/677,308.

U.S. Advisory Action dated Sep. 28, 2016 in co-pending U.S. Appl. No. 14/677,308.

U.S. Notice of Allowance dated Jan. 3, 2017 in co-pending U.S. Appl. No. 14/677,308.

U.S. Appl. No. 14/677,308, filed Apr. 2, 2015, Ji-won Moon et al., Samsung Electronics Co., Ltd.

ELECTROPHOTOGRAPHIC IMAGE FORMING APPARATUS

CROSS-REFERENCE TO RELATED APPLICATIONS

This application is a continuation of U.S. patent application Ser. No. 14/677,308, filed on Apr. 2, 2015, which claims priority benefit from Korean Patent Application No. 10-2014-0067794, filed on Jun. 3, 2014 in the Korean Intellectual Property Office, the disclosures of which are incorporated herein in their entirety by reference.

BACKGROUND

1. Field

One or more embodiments relate to an electrophotographic image forming apparatus that forms an image on a recording medium by using electrophotography.

2. Description of the Related Art

An image forming apparatus using electrophotography prints an image on a recording medium by supplying toner to an electrostatic latent image formed on a photoreceptor to form a visible toner image on the photoreceptor, transferring the visible toner image onto the recording medium, and fusing the transferred visible toner image on the recording medium.

A process cartridge is an assembly of components for forming a visible toner image. The process cartridge is a consumable product that is detachable from a main body of an image forming apparatus and replaceable after lifespan thereof has ended. A process cartridge may have various structures such as a structure in which a photoreceptor, a development roller that supplies toner to the photoreceptor, and a container portion containing toner are integrally formed, a structure divided into an image cartridge including a photoreceptor and a development roller and a toner cartridge containing toner, or a structure divided into a photoreceptor cartridge including a photoreceptor, a development cartridge including a development roller, and a toner cartridge containing toner.

In a process cartridge having a structure including an imaging cartridge and a toner cartridge, the imaging cartridge has a structure in which a photoreceptor unit including a photoreceptor and a development unit including a development roller are connected to each other.

SUMMARY

In an aspect of one or more embodiments, there is provided an electrophotographic image forming apparatus whereby a stable image quality may be obtained during the lifetime of a process cartridge by reducing toner stress in a development unit.

In an aspect of one or more embodiments, there is provided an electrophotographic image forming apparatus which includes: a toner supply unit that includes a toner containing unit and a toner discharging unit in which a toner outlet is provided; a photoreceptor unit including a photoreceptor on which an electrostatic latent image is formed; a development unit including a development roller that supplies toner to the electrostatic latent image to develop the electrostatic latent image and a supply roller that supplies toner received from the toner containing unit via the toner outlet to the development roller; a first toner supply member that supplies toner of the toner containing unit to the toner discharging unit; and a second toner supply member that transports toner of the toner discharging unit to the toner outlet, wherein the first toner supply member is located in a second quadrant from among first through fourth quadrants which are determined based on a vertical line and a horizontal line which intersect at the second toner supply member as the origin, and wherein the photoreceptor and the supply roller and the development roller are located in the fourth quadrant.

The photoreceptor may be exposed by light that passes through the first quadrant.

The toner supply unit may include a waste toner containing unit in which waste toner removed from the photoreceptor is accommodated and a waste toner dispersing member that is disposed in the waste toner containing unit and disperses waste toner, and the waste toner dispersing member may be located in the third quadrant.

The development unit may further include: a toner inlet facing the toner outlet and a first toner transporting member that transports toner supplied through the toner inlet in an axial direction of the supply roller and a toner supply guide that is disposed between the first toner transporting member and the supply roller and includes a slit which has a length in the axial direction and through which toner is dropped onto the supply roller, wherein the first toner transporting member is located in the fourth quadrant.

The development unit may further include a second toner transporting member that stirs toner in the development unit to supply the toner in the development unit to the supply roller, and the second toner transporting member may be located in the third quadrant.

The slit may be disposed upstream of a contact area between the supply roller and the development roller with respect to a rotational direction of the supply roller.

At least a portion of a projection area of the slit may overlap with a projection area of the supply roller in a gravitational direction.

The slit may be inclined with respect to the axial direction.

The slit may include a plurality of slits arranged in the axial direction.

Among the plurality of slits, an opening area of a slit located further away from the toner inlet may be greater than an opening area of a slit located closer to the toner inlet.

Respective opening areas of the plurality of slits may increase with distance from the toner inlet.

The toner supply guide may be downwardly inclined from a first end portion close to the toner inlet to a second end portion that is opposite to the first end portion.

The first toner transporting member may include a rotational shaft and a spiral wing, the spiral wing may include a first spiral wing that is close to the toner inlet and a second spiral wing that is disposed downstream of the first spiral wing with respect to a toner transportation direction, and a pitch of the first spiral wing may be smaller than a pitch of the second spiral wing.

A spiral direction of the first spiral wing may be the same as a spiral direction of the second spiral wing.

The spiral wing may further include a third spiral wing that is disposed downstream of the second spiral wing with respect to the toner transportation direction, and a spiral direction of the third spiral wing may be opposite to the spiral direction of the first spiral wing.

The electrophotographic image forming apparatus may further include a toner level detecting unit that detects a toner level of the development unit.

The toner level detecting unit may include: a light emitting unit; a first light guide member that includes a light exit surface through which light that is emitted from the light emitting unit is transmitted; a second light guide member that includes a light incident surface that is spaced apart from and faces the light exit surface, wherein the light transmitted through the light exit surface is incident to the light incident surface; and a light receiving unit that detects the incident light.

The light emitting unit and the light receiving unit may be disposed outside the development unit, and the light exit surface and the light incident surface may be disposed inside the development unit.

The electrophotographic image forming apparatus may further include: a second toner transporting member that rotates to supply toner of the development unit to the supply roller; and a wiper that is mounted in the second toner transporting member and periodically wipes the light exit surface and the light incident surface.

When a radius of the supply roller is r1, a radius of the development roller is r2, an axial distance between the supply roller and the development roller is D, r1=8.5 mm to 9.5 mm, and r2=9.5 mm to 10.5 mm, r1+r2−D may be 0.8 mm or smaller.

r1+r2−D may be 0.2 mm or greater.

The toner supply unit may be in the form of a replaceable toner cartridge.

The development unit and the photoreceptor unit may be in the form of a replaceable imaging cartridge.

BRIEF DESCRIPTION OF THE DRAWINGS

These and/or other aspects will become apparent and more readily appreciated from the following description of embodiments, taken in conjunction with the accompanying drawings in which.

DETAILED DESCRIPTION

Figure 1:
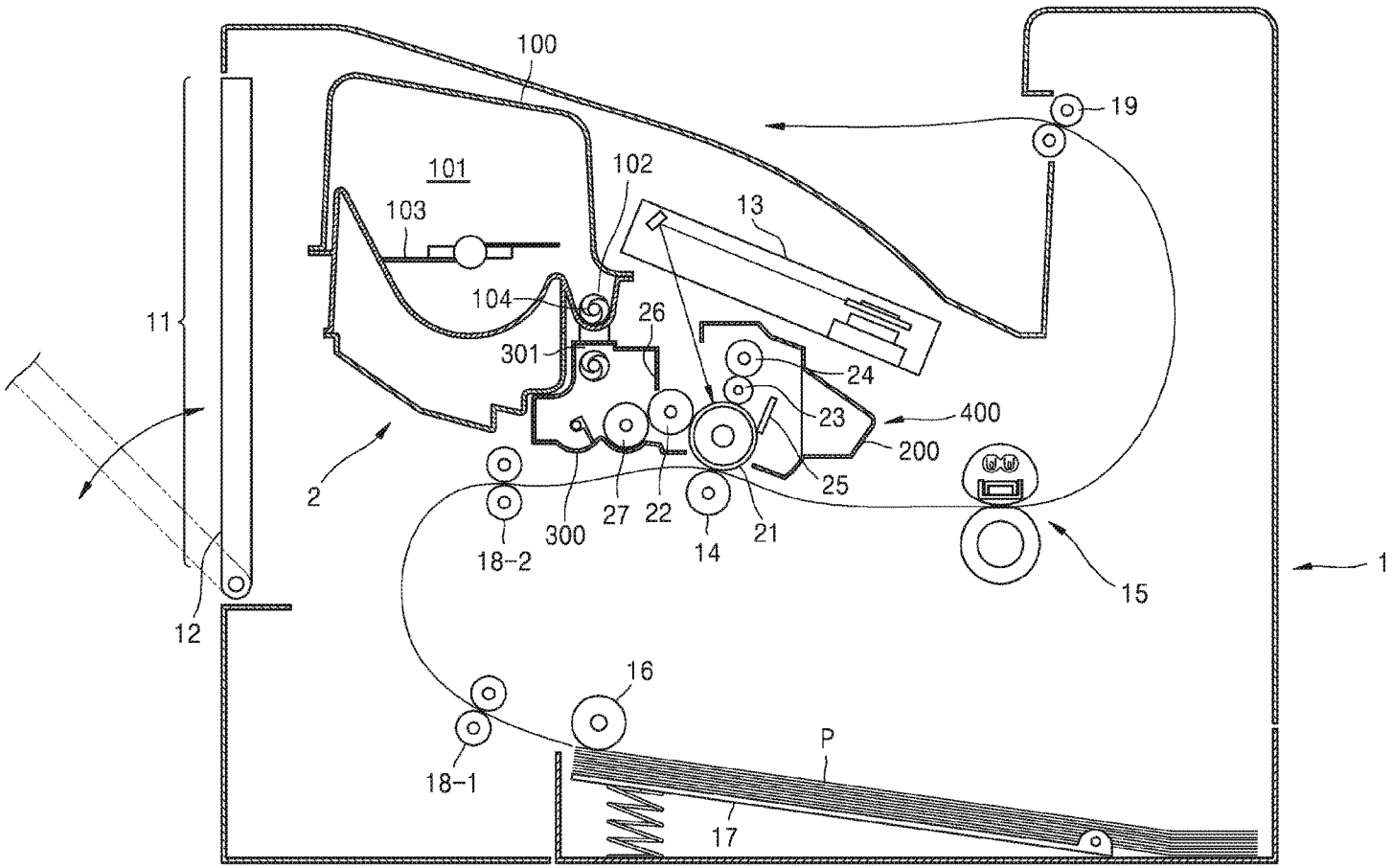
FIG. 1 is a schematic structural diagram of an electrophotographic image forming apparatus according to an embodiment.

Reference will now be made in detail to embodiments, examples of which are illustrated in the accompanying drawings, wherein like reference numerals refer to like elements throughout. In the specification and drawings, elements having substantially the same functions and structures will be labeled with the same reference numerals. In this regard, embodiments may have different forms and should not be construed as being limited to the descriptions set forth herein. Accordingly, embodiments are merely described below, by referring to the figures, to explain aspects of the present description. Expressions such as "at least one of," when preceding a list of elements, modify the entire list of elements and do not modify the individual elements of the list.

FIG. 1 is a schematic structural diagram of an electrophotographic image forming apparatus according to an embodiment.

Referring to FIG. 1, a main body 1 of the image forming apparatus and a process cartridge 2 are shown. The main body 1 includes an opening 11 providing a passage for the process cartridge 2 to be mounted in or removed from the main body 1. A cover 12 closes or opens the opening 11. The main body 1 includes an exposure unit 13, a transfer roller 14, and a fusing unit 15. Also, the main body 1 includes a recording medium transfer structure for loading and transferring a recording medium P where an image is to be formed.

The process cartridge 2 may include a toner containing unit 101, a photoconductive drum 21 having a surface on which an electrostatic latent image is formed, and a development roller 22 that receives toner from the toner containing unit 101 to supply the toner to the electrostatic latent image so as to develop the electrostatic latent image into a visible toner image.

The process cartridge 2 may have a first structure divided into an imaging cartridge 400 including the photoconductive drum 21 and the development roller 22 and a toner cartridge 100 including the toner containing unit 101, a second structure divided into a photoreceptor cartridge 200 including the photoconductive drum 21, a development cartridge 300 including the development roller 22, and a toner cartridge 100 including the toner containing unit 101, a third structure divided into a photoreceptor cartridge 200 and a development cartridge 300 including the toner containing unit 101, or a fourth structure in which a photoreceptor cartridge 200, a development cartridge 300, and a toner cartridge 100 are integrally formed with one another.

In the process cartridge 2 having the first structure (or the second structure), when the toner cartridge 100 is mounted in the main body 1, the toner cartridge 100 is connected to the imaging cartridge 400 (or the development cartridge 300). For example, when the toner cartridge 100 is mounted in the main body 1, a toner discharging unit 102 of the toner cartridge 100 and a toner inlet portion 301 of the imaging cartridge 400 (or the development cartridge 300) are connected to each other.

Figure 2:
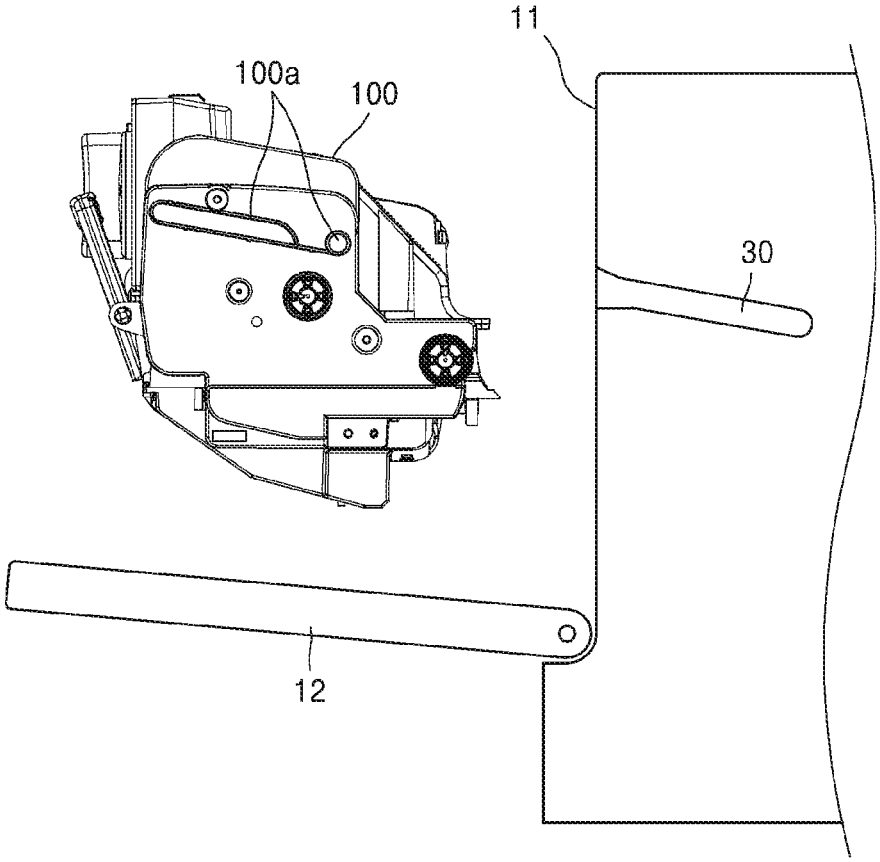
FIG. 2 illustrates replacement of a toner cartridge.

For example, the process cartridge 2 according to the present embodiment has the first structure. The imaging cartridge 400 and the toner cartridge 100 may be individually attached to or detached from the main body 1. The process cartridge 2 is a consumable product that is replaced after its lifespan expires. In general, the lifespan of the imaging cartridge 400 is longer than the lifespan of the toner cartridge 100. When toner contained in the toner cartridge 100 is completely consumed, just the toner cartridge 100 may be individually replaced as illustrated in FIG. 2, and thus, costs for replacement of consumables may be reduced. Referring to FIG. 2, for example, a guide protrusion 100*a* is formed on a side portion of the toner cartridge 100, and a guide rail 30 that guides the guide protrusion 100*a* may be provided in the main body 1. The toner cartridge 100 may be guided via the guide rail 30 to be attached to or detached from the main body 1. While not shown in the drawing, a guide unit that guides the imaging cartridge 400 is provided in the main body 1.

The photoreceptor cartridge 200 includes the photoreceptor drum 21. The photoconductive drum 21 is an example of a photoreceptor, an electrostatic latent image being formed on a surface thereof, and may include a conductive metal pipe and a photosensitive layer around the conductive metal pipe. A charging roller 23 is an example of a charger for charging the photoconductive drum 21 to have a uniform surface potential. A charging brush or a corona charger may be used instead of the charging roller 23. A reference numeral 24 denotes a cleaning roller for removing foreign materials from a surface of the charging roller 23. A cleaning blade 25 is an example of a cleaning unit for removing toner and foreign materials from a surface of the photoconductive drum 21 after a transfer process which will be described later. A cleaning unit having another shape, such as a rotating brush, may be used instead of the cleaning blade 25.

The development cartridge 300 receives toner from the toner cartridge 100 and supplies the toner to the electrostatic latent image formed on the photoconductive drum 21 so that the electrostatic latent image formed on the photoconductive drum 21 is developed into the visible toner image.

Figure 3A:
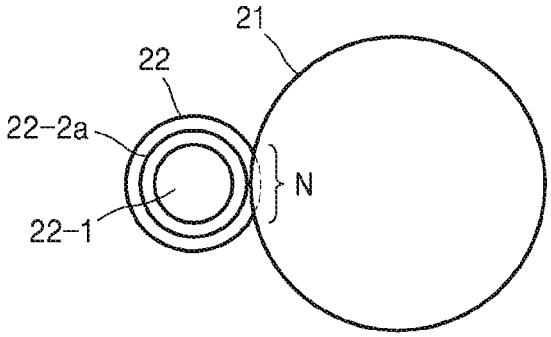
FIG. 3A is a diagram of an arrangement of a photoconductive drum and a development roller according to a contact development method.
Figure 3B:
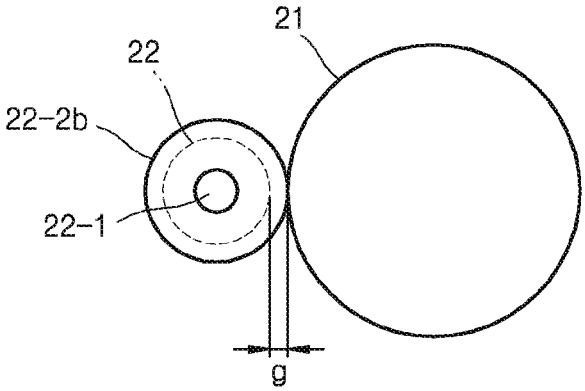
FIG. 3B is a diagram of an arrangement of a photoconductive drum and a development roller according to a non-contact development method.

Examples of a development method include a one-component development method in which toner is used and a two-component development method in which toner and a carrier are used. The process cartridge 2 according to the current embodiment uses a one-component development method. The development roller 22 is used to supply toner to the photosensitive drum 21. A development bias voltage to supply toner to the photosensitive drum 21 may be applied to the development roller 22. The one-component development method may be classified into a contact development method, wherein the development roller 22 and the photoconductive drum 21 are rotated while contacting each other, and a non-contact development method, wherein the development roller 22 and the photoconductive drum 21 are rotated by being spaced apart from each other by dozens to hundreds of microns. FIG. 3A is a diagram of an arrangement of the photoconductive drum 21 and the development roller 22 in the contact development method, and FIG. 3B is a diagram of an arrangement of the photoconductive drum 21 and the development roller 22 in the non-contact development method. Referring to FIG. 3A, in the contact development method, a gap maintaining member 22-2*a* having a smaller diameter than the development roller 22 may be provided on each of both ends of a rotation shaft 22-1 of the development roller 22. A contact amount of the development roller 22 to the photoconductive drum 21 is constrained by the gap maintaining member 22-2*a* which contacts the surface of the photoconductive drum 21. A development nip N is formed as the development roller 22 contacts the photoconductive drum 21. Referring to FIG. 3B, in the non-contact development method, a gap maintaining member 22-2*b* having a larger diameter than the development roller 22 may be provided on each of the both ends of the rotation shaft 22-1 of the development roller 22. A development gap g between the development roller 22 and the photoconductive drum 21 is constrained by the gap maintaining member 22-2*b* which contacts the surface of the photoconductive drum 21. To maintain the development gap g and the development nip N, it is sufficient that the gap maintaining members 22-2*a* and 22-2*b* contact an object, and the gap maintaining members 22-2*a* and 22-2*b* do not necessarily have to contact the surface of the photoconductive drum 21.

A regulator 26 regulates an amount of toner supplied from the development roller 22 to a development region where the photoconductive drum 21 and the development roller 22 face each other. The regulator 26 may be a doctor blade elastically contacting a surface of the development roller 22. A supply roller 27 supplies toner in the process cartridge 2 to a surface of the development roller 22. To this end, a supply bias voltage may be applied to the supply roller 27.

When a two-component development method is used, the development roller 22 is spaced apart from the photoconductive drum 21 by dozens to hundreds of microns. Although not illustrated in the drawings, the development roller 22 may have a structure in which a magnetic roller is disposed in a hollow cylindrical sleeve. The toner is adhered to a surface of a magnetic carrier. The magnetic carrier is adhered to the surface of the development roller 22 to be transferred to the development region where the photoconductive drum 21 and the development roller 22 face each other. Only the toner is supplied to the photoconductive drum 21 according to the development bias voltage applied between the development roller 22 and the photoconductive drum 21, and thus the electrostatic latent image formed on the surface of the photoconductive drum 21 is developed into the visible toner image. The process cartridge 2 may include an agitator (not shown) for mixing and stirring the toner and a carrier and transporting the mixture to the development roller 22. The agitator may be, for example, an auger, and a plurality of agitators may be provided in the process cartridge 2.

The exposure unit 13 forms the electrostatic latent image on the photoconductive drum 21 by irradiating light modulated according to image information to the photoconductive drum 21. The exposure unit 13 may be a laser scanning unit (LSU) using a laser diode as a light source, or a light-emitting diode (LED) exposure unit using an LED as a light source.

The transfer roller 14 is an example of a transfer unit for transferring a toner image from the photoconductive drum 21 to the recording medium P. A transfer bias voltage for transferring the toner image to the recording medium P is applied to the transfer roller 14. A corona transfer unit or a transfer unit using a pin scorotron method may be used instead of the transfer roller 14.

The recording media P are picked up one by one from a loading table 17 by a pickup roller 16, and are transferred by feed rollers 18-1 and 18-2 to a region where the photoconductive drum 21 and the transfer roller 14 face each other.

The fusing unit 15 applies heat and pressure to an image transferred to the recording medium P so as to fuse and fix the image on the recording medium P. The recording medium P that passed through the fusing unit 15 is discharged outside the main body 1 by a discharge roller 19.

According to the above-described structure, the exposure unit 13 irradiates the light modulated according to the image information to the photoconductive drum 21 to develop the electrostatic latent image. The development roller 22 supplies the toner to the electrostatic latent image to form the visible toner image on the surface of the photoconductive drum 21. The recording medium P loaded in the loading table 17 is transferred to the region where the photoconductive drum 21 and the transfer roller 14 face each other by the pickup roller 16 and the feed rollers 18-1 and 18-2, and the toner image is transferred on the recording medium P from the photoconductive drum 21 according to the transfer bias voltage applied to the transfer roller 14. After the recording medium P passes through the fusing unit 15, the toner image is fused and fixed on the recording medium P according to heat and pressure. After the fusing, the recording medium P is discharged by the discharge roller 19.

Hereinafter, the imaging cartridge 400, the photoreceptor cartridge 200, the development cartridge 300, and the toner cartridge 100 will be respectively referred to as an imaging unit (400), the photoreceptor unit 200, the development unit 300, and a toner supply unit. The photoreceptor unit 200 and the development unit 300 may be connected to each other such that the development nip N or the development gap g is maintained.

Figure 4:
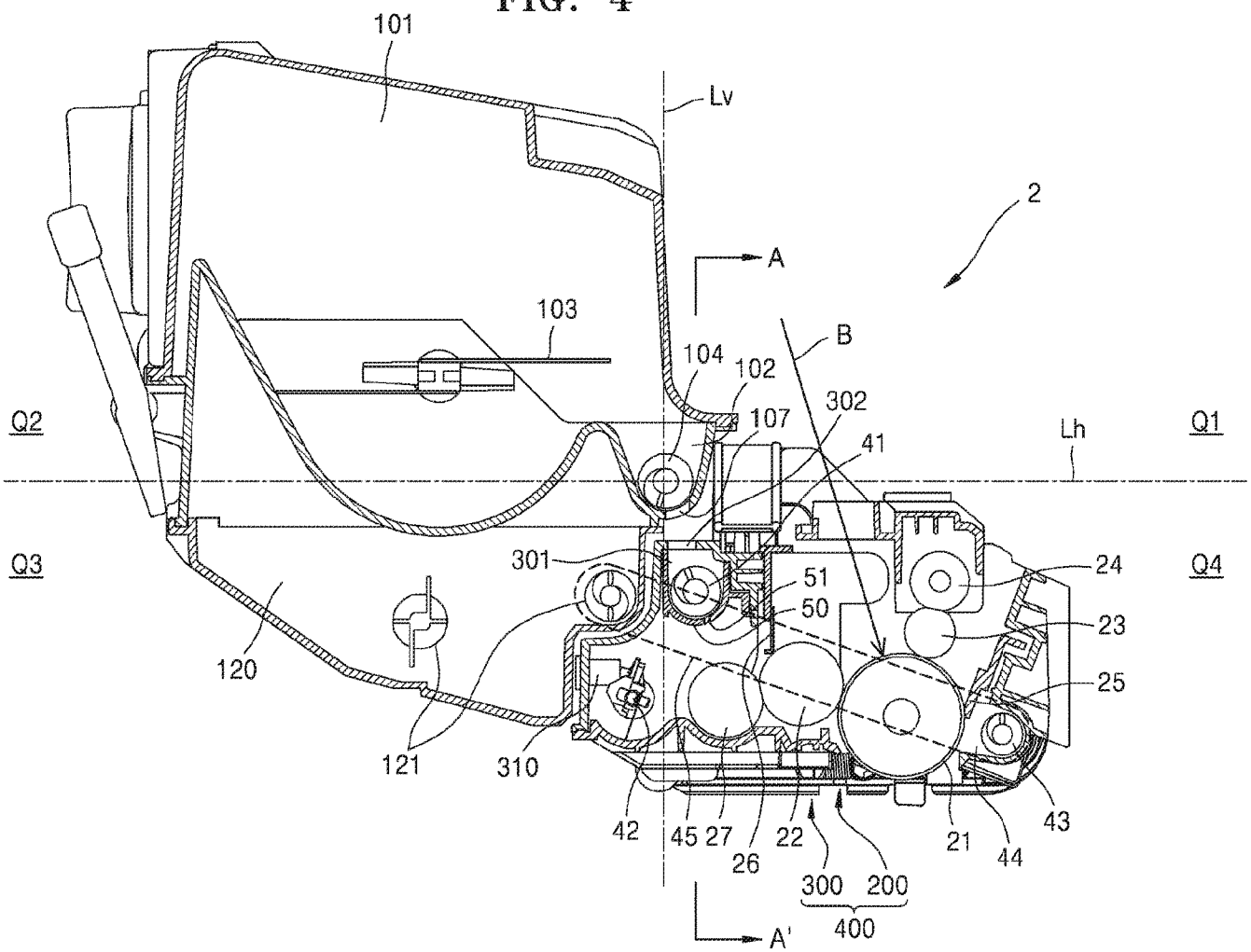
FIG. 4 is a cross-sectional view of a process cartridge according to an embodiment.

FIG. 4 is a cross-sectional view of the process cartridge 2 according to an embodiment. Referring to FIG. 4, the development unit 300 is disposed below the toner containing unit 101 in a gravitational direction. According to this structure, toner contained in the toner containing unit 101 may be easily supplied to the development unit 300 due to gravity.

The toner contained in the toner containing unit 101 is discharged from the toner cartridge 100 through a toner outlet 107 provided at the toner discharging unit 102 and is supplied to the development unit 300 through a toner inlet 302 that is provided at the toner inlet portion 301 to face the toner outlet 107. The toner outlet 107 is disposed at an end portion of the toner discharging unit 102 in a length direction thereof. The length direction of the toner discharging unit 102 and the toner inlet portion 301 refers to an axial direction of the photoconductive drum 21 and the development roller 22. Hereinafter, the 'length direction' refers to the axial direction of the photoconductive drum 21, the development roller 22, and the supply roller 27.

A first toner supply member 103 that supplies toner to the toner discharging unit 102 is disposed in the toner containing unit 101. A second toner supply member 104 that transports toner to the toner outlet 107 disposed at the end portion of the toner discharging unit 102 is disposed in the toner discharging unit 102. The first toner supply member 103 radially transports the toner to supply the same to the toner discharging unit 102. For example, a rotating paddle may be used as the first toner supply member 103. The second toner supply member 104 transports the toner supplied by using the first toner supply member 103 in the length direction. For example, an auger may be used as the second toner supply member 104.

A first toner transporting member 41 that transports toner in the length direction may be disposed in the toner inlet portion 301. For example, an auger may be used as the first toner transporting member 41. A toner supply guide 50 that extends in the length direction is disposed under the first toner transporting member 41. The toner supply guide 50 is disposed above the supply roller 27 in a gravitational direction. For example, the toner supply guide 50 may have a shape surrounding a lower portion of the first toner transporting member 41 disposed thereinside. A slit 51 is formed in the toner supply guide 50. Toner that is transported by using the first transporting member 41 in the length direction drops into the inner space of the development unit 300 through the slit 51. The toner may immediately drop on a surface of the supply roller 27 and part of the toner may drop into the inner space of the development unit 300.

A second toner transporting member 42 may be further disposed in the development unit 300. The second toner transporting member 42 supplies to the supply roller 27 again the toner that is not immediately supplied from the toner inlet 302 to the surface of the supply roller 27 and is supplied to the development chamber 45 and toner that is separated from the surface of the supply roller 27. For example, a paddle that radially transports toner may be used as the second toner transporting member 42.

A waste toner discharging member 43 is included, which transports in an axial direction waste toner that is removed from a surface of the photoconductive drum 21 by using the cleaning blade 25 after transferring, to an end portion of the waste toner accommodation space 44. The waste toner is carried to a waste toner containing unit 120 that is provided in the toner containing unit 101 via a waste toner transporting unit 45 that connects the waste toner accommodation space 44 and the waste toner containing unit 120. The waste toner containing unit 120 is provided below the toner containing unit 101 in a gravitational direction. Accordingly, a difference in heights of the waste toner transporting member 42 and the waste toner containing unit 120 may be kept small so as to stably and effectively transporting waste toner to the waste toner containing unit 120. A waste toner dispersing member 121 that disperses the waste toner inside the waste toner containing unit 120 may be disposed in the waste toner containing unit 120.

As illustrated in FIG. 4, the process cartridge 2 may be divided into four quadrants Q1, Q2, Q3, and Q4 by a vertical line Lv and a horizontal line Lh which intersect at the second toner supply member 104 as the origin. When the toner containing unit 101 and the first toner supply member 103 are located in the second quadrant Q2, the supply roller 27, the development roller 22, and the photoconductive drum 21 are located in the fourth quadrant Q4 that is in a diagonal direction to the second quadrant Q2. According to this structure, toner may be spontaneously supplied from the toner containing unit 101 to the development unit 300 due to gravity. The waste toner containing unit 120 and the waste toner dispersing member 121 are located in the third quadrant Q3 below the second quadrant Q2. According to this structure, a step between the waste toner discharging member 43 and the waste toner containing unit 120 in a gravitational direction may be reduced, and thus, the waste toner removed from the photoconductive drum 21 may be easily transported to the waste toner containing unit 120. The first toner transporting member 41 is located in the fourth quadrant Q4. A capacity of the waste toner containing unit 120 is relatively small compared to that of the toner containing unit 101. Accordingly, the inner space of the development unit 300 extends from the fourth quadrant Q4 to the third quadrant Q3, and the second toner transporting member 42 is disposed in the extended portion. That is, the second toner transporting member 42 is located in the third quadrant Q3. Accordingly, the development unit 300 and the photoreceptor unit 200 may be efficiently arranged in the third quadrant Q3 and the fourth quadrant Q3 so as to reduce a length of the process cartridge 2 or the imaging unit (imaging cartridge) 400. Light B that exposes the photoconductive drum 21 passes through the first quadrant Q1 and is incident on the photoconductive drum 21.

Figure 5:
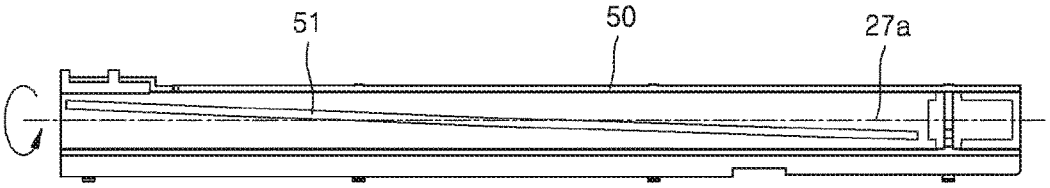
FIG. 5 is a plan view of a toner supply guide according to an embodiment.

FIG. 5 is a plan view of the toner supply guide 50 according to an embodiment. Referring to FIG. 5, a slit 51 is inclined with respect to the length of the toner supply guide 50, that is, with respect to the length direction of the supply roller 27. An amount of toner supplied to the supply roller 27 through the slit 51 is proportional to an area of an opening of the slit 51. According to the structure of FIG. 5, by using the toner supply guide 50 including the slit 51 that is inclined, a length of the slit 51 may be longer than a length of the toner supply guide 50, and thus, an opening area of the slit 51 may be increased. Accordingly, toner may be easily and stably supplied to the supply roller 27.

Figure 6:
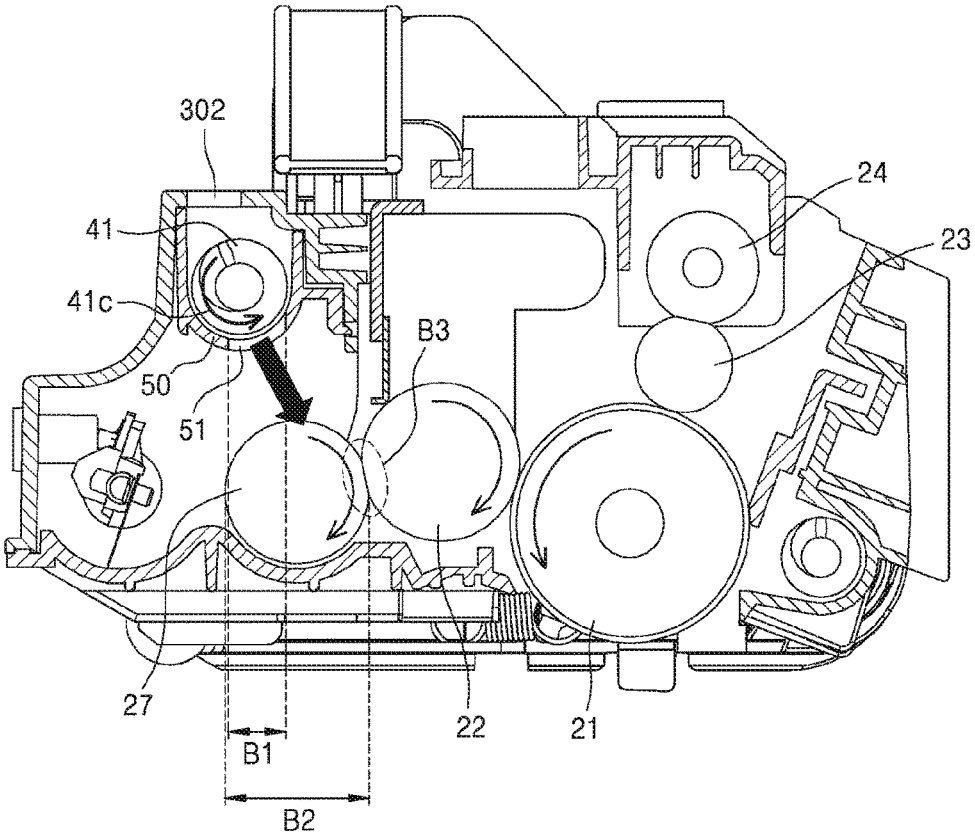
FIG. 6 is a cross-sectional view illustrating a position relationship between a supply roller and a slit.

FIG. 6 is a cross-sectional view illustrating a position relationship between the supply roller 27 and the slit 51. Referring to FIG. 6, the slit 51 is disposed above the supply roller 27 in a gravitational direction. At least a portion of a projection area B1 of the slit 51 in the gravitational direction overlaps with a projection area B2 of the supply roller 27 in the gravitational direction. The slit 51 is disposed upstream of a contact area B3 located between the development roller 22 and the supply roller 27 with respect to a rotational direction of the supply roller 27. According to the above-described structure, toner drops from the slit 51 onto the supply roller 27, and thus, fresh toner supplied from the toner cartridge 100 may be immediately supplied to the development roller 22 through the supply roller 27. Toner supplied from the toner cartridge 100 has a low degree of stress and thus an image may be stably formed by using the toner. Thus, degradation of toner properties due to stress and degradation in an image quality resulting therefrom may be prevented.

Also, the first toner transporting member 41 rotates in a direction 41*c* in which toner is supplied towards the contact area B3 located between the supply roller 27 and the development roller 22. Accordingly, toner that is transported along the toner supply guide 50 in the length direction by the first toner transporting member 41 drops into the development unit 300, and a dropping direction thereof is spontaneously deviated toward the supply roller 27 according to the rotational direction 41*c* of the first toner transporting member 41. Accordingly, fresh toner may be easily supplied to the supply roller 27.

Figure 7:
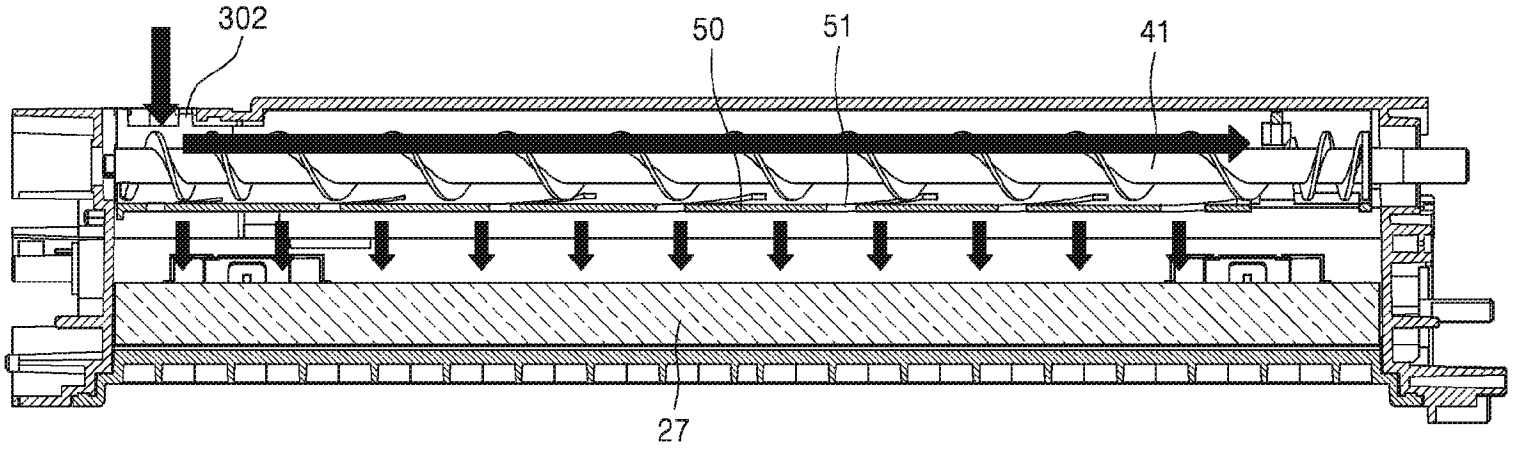
FIG. 7 is a cross-sectional view of the process cartridge cut along a line A-A', wherein toner is supplied from a toner inlet portion to a development unit.
Figure 8:
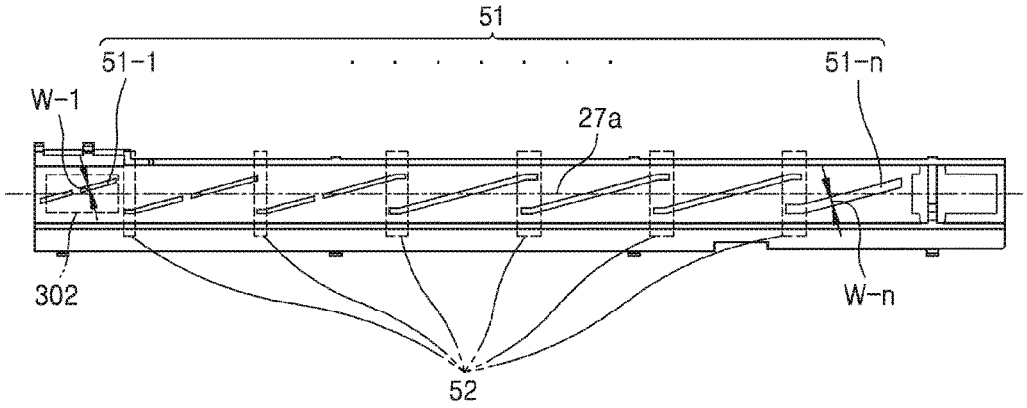
FIG. 8 is a plan view of a toner supply guide illustrated in FIG. 7 according to an embodiment.
Figure 9:
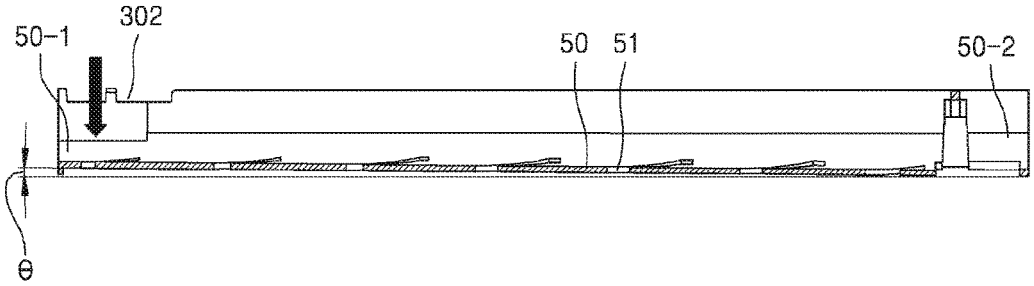
FIG. 9 is a cross-sectional view of a toner supply guide illustrated in FIG. 7 according to an embodiment.

FIG. 7 is a cross-sectional view of the process cartridge 2 cut along a line A-A', wherein toner is supplied via the toner inlet 302 to the development unit 300. FIG. 8 is a plan view of the toner supply guide 50 illustrated in FIG. 7 according to an embodiment. FIG. 9 is a cross-sectional view of the toner supply guide 50 illustrated in FIG. 7 according to an embodiment.

Referring to FIGS. 4, 7, and 8, the slit 51 includes a plurality of slits 51-1 through 51-*n* that are arranged in the length direction. The plurality of slits 51-1 through 51-*n* are inclined with respect to the length direction, that is, with respect to an axial direction 27*a* of the supply roller 27. An amount of toner that is supplied to the supply roller 27 through the slit 51 is proportional to an opening area of the slit 51. According to the structure illustrated in FIG. 8, by using the toner supply guide 50 including the plurality of slits 51-1 through 51-*n* that are inclined with respect to the axial direction 27*a* of the supply roller 27, the opening area of the plurality of slits 51-1 through 51-*n* may be increased, thereby easily and stably supplying toner to the supply roller 27.

The plurality of slits 51-1 through 51-*n* each include an overlapping portion 52 where adjacent slits 51-1 through 51-*n* overlap. As the overlapping portion 52 is provided, toner may be supplied without leaking to any area in the length direction of the supply roller 27.

At least a portion of a projection area of the plurality of slits 51-1 through 51-*n* overlaps with a projection area of the supply roller 27 in a gravitational direction. The plurality of slits 51-1 through 51-*n* are located upstream of the contact area B3 (see FIG. 6) located between the supply roller 27 and the development roller 22 with respect to a rotational direction of the supply roller 27. According to the above-described structure, fresh toner supplied from the toner cartridge 100 may be immediately supplied to the development roller 22 through the supply roller 27, and thus, degradation in properties of toner due to stress and degradation in an image quality resulting therefrom may be prevented.

In order to obtain uniform image quality, an amount of toner that is supplied to the supply roller 27 has to be uniform in a length direction, that is, in the axial direction 27*a*. Toner is supplied to the toner supply guide 50 through the toner inlet 302, and is transported in the length direction of the toner supply guide 50 by using the first toner transporting member 41. Thus, an amount of toner in the toner supply guide 50 may be larger towards the toner inlet 302, and may be smaller away from the toner inlet 302. Considering that the amount of toner in the toner supply guide 50 depends on the location of toner with respect to the toner inlet 302, an opening area of the slit 51-*n* that is relatively far from the toner inlet 302 may be greater than an opening area of the slit 51-1 that is relatively close to the toner inlet 302. Opening areas of the plurality of slits 51-1 through 51-*n* may be increased with distance from the toner inlet 302. The plurality of slits 51-1 through 51-*n* may be divided into a plurality of groups, and opening areas of slits of the plurality of groups may be increased with distance from the toner inlet 302. For example, a width W-n of the slit 51-*n* may be greater than a width W-1 of the slit 51-1. Widths W-1 through W-n of the plurality of slits 51-1 through 51-*n* may be increased away from the toner inlet 302. In addition, the plurality of slits 51-1 through 51-*n* may be divided into a plurality of groups, and, among the plurality of groups, a width of slits of a group that is relatively far from the toner inlet 302 may be increased to be greater than a width of slits of a group that is relatively close to the toner inlet 302.

In order to provide toner to the supply roller 27 such that the toner amount is uniform in the length direction, a method in which toner is supplied to the toner supply guide 50 through the toner inlet 302 and transported easily in the length direction through the toner supply guide 50 may be considered. Referring to FIG. 9, the toner supply guide 50 may be downwardly inclined from first end portion 50-1 adjacent to the toner inlet 302 toward the second end portion 50-2 that is opposite thereto. That is, the toner supply guide 50 may be inclined downward at an angle θ. According to the above-described structure, toner may be easily transported from the first end portion 50-1 to the second end portion 50-2 of the toner supply guide 50 due to the influence of a gravitational force, and uniformity of an amount of toner supplied to the supply roller 27 in the length direction may be further increased.

Figure 10:
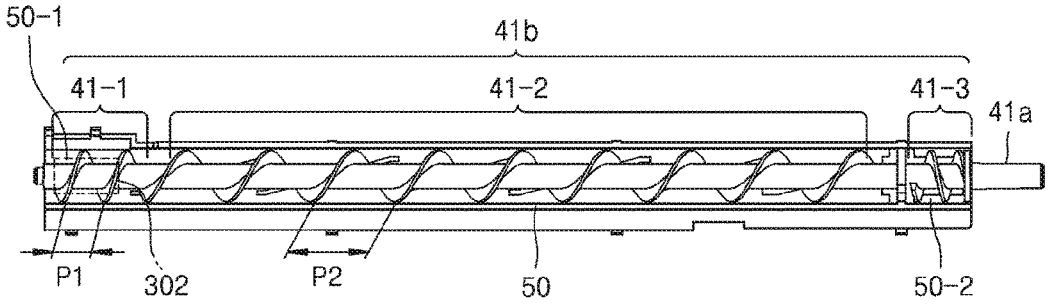
FIG. 10 is a plan view of a first toner transporting member according to an embodiment.

FIG. 10 is a plan view of the first toner transporting member 41 according to an embodiment. Referring to FIG. 10, the first toner transporting member 41 includes a rotational shaft 41*a* and a spiral wing 41*b*. When the first toner transporting member 41 rotates, toner is transported in the length direction along the spiral wing 41*b*. The amount of transported toner increases as the pitch of the spiral wing 41*b* decreases. The first end portion 50-1 of the toner supply guide 50 is adjacent to the toner inlet 302, and thus, a relatively large amount of toner may accumulate around the first end portion 50-1. Thus, the toner around the first end portion 50-1 of the toner supply guide 50 needs to be quickly transported in the length direction. In order to increase an amount of toner transported near the first end portion 50-1 of the toner supply guide 50, that is, around the toner inlet 302, the pitch of the spiral wing 41*b* around the toner inlet 302 may be small. The spiral wing 41*b* may include a first spiral wing 41-1 and a second spiral wing 41-2 that are arranged in the length direction. A spiral direction of the first spiral wing 41-1 is the same as a spiral direction of the second spiral wing 41-2. Accordingly, the first spiral wing 41-1 and the second spiral wing 41-2 transport toner in the same direction. The first spiral wing 41-1 is disposed adjacent to the toner inlet 302, and the second spiral wing 41-2 is disposed downstream of the first spiral wing 41-1 with respect to a toner transportation direction. A pitch P1 of the first spiral wing 41-2 is smaller than a pitch P2 of the second spiral wing 41-2. According to the above-described structure, toner supplied through the toner inlet 302 is quickly transported in the length direction, thereby limiting the amount of toner that accumulates around the toner inlet 302 and preventing a toner supply failure due to the accumulation of toner and degradation in an image quality due to the toner supply failure.

Referring to FIG. 10 again, toner that is supplied through the toner inlet 302 is transported from the first end portion 50-1 to the second end portion 50-2 of the toner supply guide 50 via the first and second spiral wings 41-1 and 41-2. When the toner reaches the second end portion 50-2 of the toner supply guide 50, toner is not able to be transported further, and thus, toner may accumulate around the second end portion 50-2. According to the present embodiment, the spiral wing 41*b* may further include a third spiral wing 41-3 that is disposed at the second end portion 50-2 of the toner supply guide 50. A spiral direction of the third spiral wing 41-3 is opposite to those of the first and second spiral wings 41-1 and 41-2. Accordingly, toner is transported in a reverse direction via the third spiral wing 41-3, and toner accumulation at the second end portion 50-2 of the toner supply guide 50 may thereby be prevented.

To achieve a uniform image quality during the lifetime of the process cartridge 2, a degree of toner stress which is the cause of degradation in the properties of toner is to be reduced. If toner stays for a long time in the inner space of the development unit 300, the toner is stirred by the second toner transporting member 42 and receives stress. If too much toner exists in the development unit 300, a toner pressure increases. The excessive toner pressure is the cause of an increase in toner stress and an increase in a driving load of the process cartridge 2. Thus, by maintaining a toner level of the development unit 300 at a predetermined level such that new toner is supplied from the toner containing unit 101 to the development unit 300 only when the toner level drops below the predetermined level, stress applied to the toner may be reduced.

Figure 11:
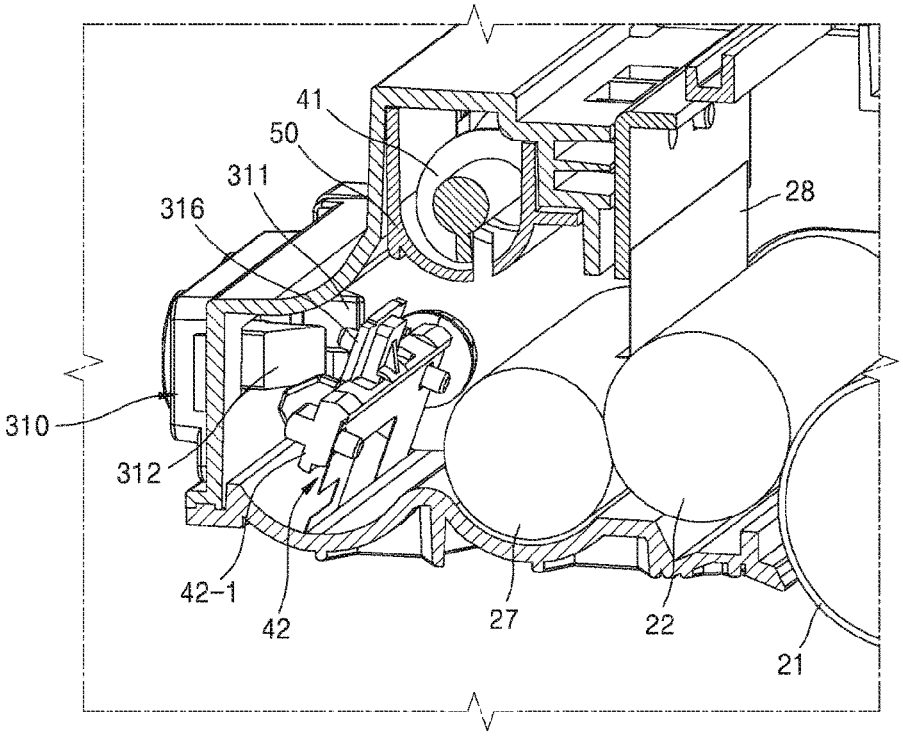
FIG. 11 is a partial cross-sectional perspective view of a development unit in which a toner level detecting unit is disposed.
Figure 12:
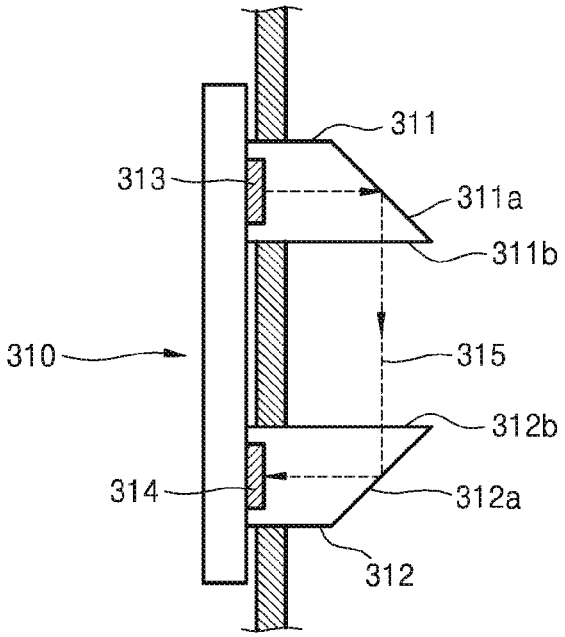
FIG. 12 is a schematic structural diagram of a toner level detecting unit.

A toner level detecting unit 310 that detects a level of toner therein is disposed in the development unit 300. FIG. 11 is a partial cross-sectional perspective view of the development unit 300 in which the toner level detecting unit 310 is disposed. FIG. 12 is a schematic structural diagram of the toner level detecting unit 310.

Referring to FIGS. 11 and 12, the toner level detecting unit 310 includes a light emitting unit 313 and a light receiving unit 314. Light 315 emitted from the light emitting unit 313 passes through the development unit 300 to be incident to the light receiving unit 314. The light emitting unit 313 and the light receiving unit 314 are disposed outside the development unit 300 in order to prevent pollution thereof by toner. First and second light guide members 311 and 312 that guide the light 315 emitted from the light emitting unit 313 to pass through the development unit 300 up to the light receiving unit 314 are provided. The first and second light guide members 311 and 312 are spaced apart from each other in the development unit 300. The first light guide member 311 guides the light 315 emitted from the light emitting unit 313 to the inner space of the development unit 300. The second light guide member 312 guides the light 315 that has passed through the development unit 300 to the light receiving unit 314. The first and second light guide members 311 and 312 respectively include first and second light path converting units 311*a* and 312*a*. The first light path converting unit 311*a* reflects the light 315 emitted from the light emitting unit 313, toward the second light path converting unit 312*a*, and the second light path converting unit 312*a* reflects the incident light 315 toward the light receiving unit 314. The first and second light guide members 311 and 312 may be formed of a light-transmissive material such that the light 315 may pass therethrough. The first and second light path converting units 311*a* and 312*a* may be, for example, inclined surfaces having a predetermined inclination angle. An inclination angle of the inclined surfaces may be, for example, an angle that satisfies a total internal reflection condition.

According to the above-described structure, an amount of light detected by the light receiving unit 314 is varied according to the toner level of the development unit 300, and thus, the toner level in the development unit 300 may be detected based on the amount of light received by the light receiving unit 314. When the toner level in the development unit 300 is lower than a predetermined reference level, the first toner supply member 103 and the second toner supply member 104 may be driven to supply toner from the toner cartridge 100 to the development unit 300. Accordingly, excessive supply of toner to the development unit 300 and an increase in the toner pressure may be prevented to thereby reduce a stress applied to the toner.

The light exit surface 311*b* and the light incident surface 312*b* which face each other, of the first and second light guide members 311 and 312, contact toner in the developing unit 300. If the light exit surface 311*b* and the light incident surface 312*b* are polluted by the toner, it is difficult to reliably detect the toner level. Referring to FIG. 11, a wiper 316 that wipes the light exit surface 311*b* and the light incident surface 312*b* is provided in the development unit 300. The wiper 316 periodically wipes the light exit surface 311*b* and the light incident surface 312*b* to remove toner attached on the light exit surface 311*b* and the light incident surface 312*b*. According to an embodiment, the wiper 316 may be mounted at a rotational shaft 42-1 of the second toner transporting member 42 to rotate therewith and wipe the light exit surface 311*b* and the light incident surface 312*b*. This structure may improve reliability of detection of the toner level.

Figure 13:
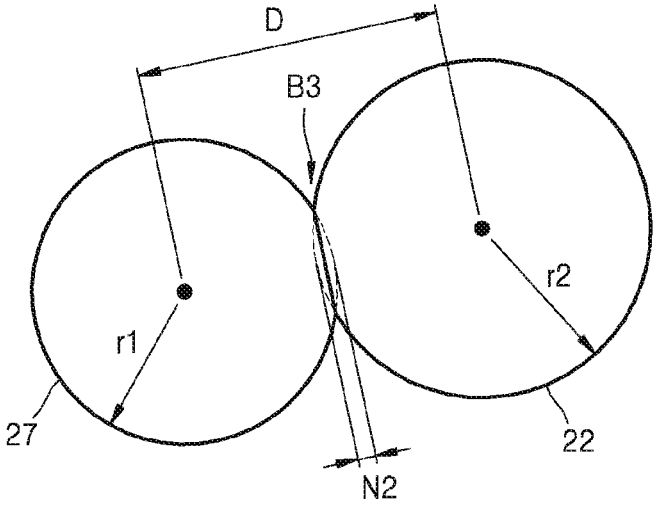
FIG. 13 illustrates a position relationship between a supply roller and a development roller.

FIG. 13 illustrates a position relationship between the supply roller 27 and the development roller 22. Referring to FIG. 13, the supply roller 27 and the development roller 22 rotate in contact with each other. A contact nip N2 is formed in the contact area B3 located between the supply roller 27 and the development roller 22. The greater the size of contact nip N2, the greater a frictional force between toner, the supply roller 27 and the development roller 22 at the contact nip N2, and thus, toner stress is increased. On the contrary, if the size of the contact nip N2 is too small, a force for supplying toner to the development roller 22 is degraded. According to experiments, a force appropriate for supplying toner may be secured when the contact nip N2 is 0.2 mm or greater. In addition, when a radius of the supply roller 27 is r1, a radius of the development roller 22 is r2, an axial distance between the supply roller 27 and the development roller 22 is D, r1 is 9.5 mm to 10.5 mm, r2 is 8.5 mm to 18.6 mm, and the contact nip N2, r1+r2−D is 0.8 mm or smaller, no excessive toner stress results and a stable image quality may be obtained during the lifetime of the process cartridge 2. That is, by setting the contact nip N2 to be from about 0.2 mm to about 0.8 mm, a force for supplying toner applied from the supply roller 27 to the development roller 22 may be secured, and at the same time, a toner stress may be kept at an appropriate level or lower.

While the process cartridge 2 having the first structure is described with reference to the above-described embodiments, embodiments are not limited thereto. The process cartridge 2 according to embodiments may also have a second, third, or fourth structure. In this case, a 'cartridge' may refer to the imaging cartridge 400 having the first structure, the developing cartridge 300 having the second structure, the developing cartridge 300 having the third structure including the toner containing unit 101, or the process cartridge 2 having the fourth structure.

It should be understood that the exemplary embodiments described therein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope of the present disclosure as defined by the following claims and their equivalents.

What is claimed is:

1. A cartridge comprising:

a development chamber having a toner inlet configured to allow toner to be supplied through the toner inlet into the development chamber;

a development roller in the development chamber;

a supply roller in the development chamber, the supply roller configured to supply toner to the development roller;

a first toner transporting member configured to transport toner supplied through the toner inlet in an axial direction of the supply roller; and a toner supply guide that is disposed between the first toner transporting member and the supply roller, the toner supply guide including:

a body extending in the axial direction and downwardly inclined such that an upper surface of the body at a first axial end portion thereof, that is configured to receive toner via the toner inlet disposed adjacent to the first axial end portion, is higher than the upper surface of the body at a second axial end portion thereof, and a slit, formed in the body and elongated in the axial direction, configured to allow toner to be dropped through the slit onto the supply roller.

2. The cartridge of claim 1, further comprising:

a second toner transporting member configured to stir toner in the development chamber to supply the toner in the development chamber to the supply roller.

3. The cartridge of claim 1, wherein the slit is disposed upstream of a contact area between the supply roller and the development roller with respect to a rotational direction of the supply roller.

4. The cartridge of claim 3, wherein at least a portion of a projection area of the slit overlaps with a projection area of the supply roller in a gravitational direction.

5. The cartridge of claim 3, wherein the slit is inclined with respect to the axial direction of the supply roller.

6. The cartridge of claim 5, wherein the slit comprises a plurality of slits arranged in the axial direction of the supply roller.

7. The cartridge of claim 6, wherein, among the plurality of slits, an opening area of a first slit located further away from the toner inlet is greater than an opening area of a second slit located closer to the toner inlet.

8. The cartridge of claim 6, wherein respective opening areas of the plurality of slits increase with distance from the toner inlet.

9. The cartridge of claim 1, further comprising:

a toner level detecting unit configured to detect a toner level of the development chamber.

10. The cartridge of claim 9, wherein the toner level detecting unit comprises:

a light emitting unit;

a first light guide member that comprises a light exit surface through which light that is emitted from the light emitting unit is transmitted;

a second light guide member that comprises a light incident surface that is spaced apart from and faces the light exit surface, wherein the light transmitted through the light exit surface is incident to the light incident surface; and a light receiving unit configured to detect the incident light.

11. The cartridge of claim 10, wherein the light emitting unit and the light receiving unit are disposed outside the development chamber, and the light exit surface and the light incident surface are disposed inside the development chamber.

12. The cartridge of claim 11, further comprising:

a second toner transporting member configured to rotate to supply toner of the development chamber to the supply roller; and a wiper that is mounted in the second toner transporting member and configured to periodically wipe the light exit surface and the light incident surface.

13. The cartridge of claim 1, wherein when a radius of the supply roller is r1, a radius of the development roller is r2, an axial distance between the supply roller and the development roller is D, r1=8.5 mm to 9.5 mm, and r2=9.5 mm to 10.5 mm, r1+r2−D is 0.8 mm or smaller.

14. The cartridge of claim 1, further comprising:

a toner supply unit configured to contain toner and to supply the toner to the development chamber via the toner inlet.

15. The cartridge of claim 14, wherein the toner supply unit forms a replaceable toner cartridge.

16. The cartridge of claim 1, further comprising:

a photoreceptor unit comprising a photoreceptor on which an electrostatic latent image is formed, wherein the development roller is configured to supply toner to the electrostatic latent image to develop the electrostatic latent image.

17. The cartridge of claim 16, wherein the photoreceptor unit forms a replaceable photoreceptor cartridge.

18. A cartridge comprising:

a development chamber having a toner inlet configured to allow toner to be supplied through the toner inlet into the development chamber;

a development roller in the development chamber;

a supply roller in the development chamber, the supply roller configured to supply toner to the development roller;

a first toner transporting member configured to transport toner supplied through the toner inlet in an axial direction of the supply roller; and a toner supply guide that is disposed between the first toner transporting member and the supply roller and includes a slit which has a length in the axial direction and configured to allow toner to be dropped through the slit onto the supply roller, wherein:

the toner supply guide is downwardly inclined in the axial direction from a first end portion close to the toner inlet to a second end portion that is opposite to the first end portion, the first toner transporting member comprises a rotational shaft and a spiral wing, the spiral wing comprises a first spiral wing that is close to the toner inlet and a second spiral wing that is disposed downstream of the first spiral wing with respect to a toner transportation direction, and a pitch of the first spiral wing is smaller than a pitch of the second spiral wing.

19. The cartridge of claim 18, wherein a spiral direction of the first spiral wing is the same as a spiral direction of the second spiral wing.

20. The cartridge of claim 19, wherein:

the spiral wing further comprises a third spiral wing that is disposed downstream of the second spiral wing with respect to the toner transportation direction, and a spiral direction of the third spiral wing is opposite to the spiral direction of the first spiral wing.

* * * * *